US009344784B2

(12) United States Patent
Wen et al.

(10) Patent No.: US 9,344,784 B2
(45) Date of Patent: May 17, 2016

(54) EARPHONE WITH DUAL LOUDSPEAKERS

(71) Applicant: Transound Electronics Co.,Ltd, Dongguan (CN)

(72) Inventors: Tsengfeng Wen, Dongguan (CN); Huiguang Yang, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 14/538,301

(22) Filed: Nov. 11, 2014

(65) Prior Publication Data

US 2015/0304763 A1 Oct. 22, 2015

(30) Foreign Application Priority Data

Apr. 16, 2014 (CN) ..... 2014 1 0151138

(51) Int. Cl.

| | |
|---|---|
| ***H04R 25/00*** | (2006.01) |
| ***H04R 1/02*** | (2006.01) |
| ***H04R 9/06*** | (2006.01) |
| ***H04R 11/02*** | (2006.01) |

(52) U.S. Cl.

CPC .. *H04R 1/02* (2013.01); *H04R 9/06* (2013.01); *H04R 11/02* (2013.01); *H04R 2205/022* (2013.01)

(58) Field of Classification Search

CPC ..... H04R 1/10; H04R 1/1091; H04R 2460/00

See application file for complete search history.

(56) References Cited

U.S. PATENT DOCUMENTS

| | | | | |
|---|---|---|---|---|
| 2008/0063223 | A1* | 3/2008 | van Halteren | H04R 1/24 381/182 |
| 2011/0007929 | A1* | 1/2011 | Rabu | H04R 1/1033 381/380 |
| 2013/0010998 | A1* | 1/2013 | Seo | H04R 1/1058 381/380 |
| 2014/0205131 | A1* | 7/2014 | Azmi | H04R 1/1075 381/380 |

* cited by examiner

*Primary Examiner* — Tuan D Nguyen

(57) ABSTRACT

An earphone with dual loudspeakers includes a casing, a retaining member, a tweeter, and a woofer. The casing has a first sound outlet passage and an accommodation space therein. The retaining member is installed in the accommodation space. Two ends of the retaining member are formed with a first accommodation cavity and a second accommodation cavity, respectively. The tweeter and the woofer are respectively installed in the first and second accommodation cavities and then installed in the casing. The tweeter has a sound outlet side facing the first sound outlet passage. A second sound outlet passage is formed between the outer wall of the tweeter and the inner wall of the first accommodation cavity. The second sound outlet passage communicates with the first sound outlet passage. The woofer has a sound outlet side facing the second sound outlet passage.

1 Claim, 15 Drawing Sheets

EARPHONE WITH DUAL LOUDSPEAKERS

BACKGROUND OF THE INVENTION

1. Field of the Invention

The present invention relates to an earphone, and more particularly to an earphone with dual loudspeakers which can be assembled conveniently.

2. Description of the Prior Art

An earphone is often used for a MP3, cell phone, PDA or notebook as individual listening, so that the earphone becomes one of essential accessories of electronic products. These days, people pay much attention to timbre, so to the timbre effect of the earphone becomes more and more important. In general, a conventional earphone is provided with a loudspeaker in the casing to sound a single frequency. It is unable to output high pitch and low pitch at the same time, so the three-dimensional effect in sound is not good. For solving this problem, an earphone with dual loudspeakers is developed accordingly, which can output high pith and low pitch at the same time. This earphone becomes a favorite for the user because it can output high pith and low pitch at the same time to enhance sound effects. The conventional earphone with dual loudspeakers comprises a tweeter, a woofer, and a casing. The inner wall of the casing is formed with a plurality of limit steps. The tweeter and the woofer are installed on the corresponding limit steps in the casing to provide high pitch and lower pitch effects. However, the internal structure of this earphone with dual loudspeakers is quite complicated, which results in that the internal cavity is not uniform after assembled to influence the unity of the sound. Accordingly, the inventor of the present invention has devoted himself based on his many years of practical experiences to solve these problems.

SUMMARY OF THE INVENTION

The primary object of the present invention is to provide an earphone with dual loudspeakers to overcome the shortcomings of the prior art. The present invention has a simple structure and can be assembled conveniently to effectively lower the cost of the mold and the degree of difficulty to open the mold, ensuring the unity of the sound to enhance timbre.

In order to achieve the aforesaid objective, the earphone with dual loudspeakers of the present invention comprises a casing, a retaining member, a tweeter, and a woofer. The casing has a first sound outlet passage and an accommodation space therein. The retaining member is installed in the accommodation space. Two ends of the retaining member are formed with a first accommodation cavity and a second accommodation cavity, respectively. The tweeter is installed in the first accommodation cavity. The woofer is installed in the second accommodation cavity. The tweeter has a sound outlet side facing the first sound outlet passage. A second sound outlet passage is formed between the outer wall of the tweeter and the inner wall of the first accommodation cavity. The second sound outlet passage communicates with the first sound outlet passage. The woofer has a sound outlet side facing the second sound outlet passage.

Preferably, the casing comprises a front casing and a rear casing. The front casing and the rear casing are connected with each other to define the accommodation space therein. The first sound outlet passage is disposed in the front casing.

Preferably, the casing further has a positioning step disposed in the accommodation space. One end of the retaining member is held on the positioning step.

Preferably, the retaining member is made of a plastic material.

Preferably, the tweeter is suspended in the first accommodation cavity.

Preferably, the tweeter is a balanced armature loudspeaker.

Preferably, the woofer is a moving-coil loudspeaker.

Compared to the prior art, the present invention has obvious advantages and beneficial effects. The tweeter and the woofer are respectively installed in the first accommodation cavity and the second accommodation cavity of the retaining member and then installed in the casing. This way simplifies the assembly procedure greatly. The present invention has a simple structure and can be assembled conveniently to effectively lower the cost of the mold and the degree of difficulty to open the mold. The casing has the first sound outlet passage therein. The second sound outlet passage is formed between the outer wall of the tweeter and the inner wall of the first accommodation cavity. The second sound outlet passage communicates with the first sound outlet passage, such that high pitch sound and low pitch sound can be transmitted at the same time. The present invention can solve the problem that the cavity is not uniform so as to ensure the unity of the sound to enhance timbre.

DETAILED DESCRIPTION OF THE PREFERRED EMBODIMENTS

Embodiments of the present invention will now be described, by way of example only, with reference to the accompanying drawings.

Figure 1:
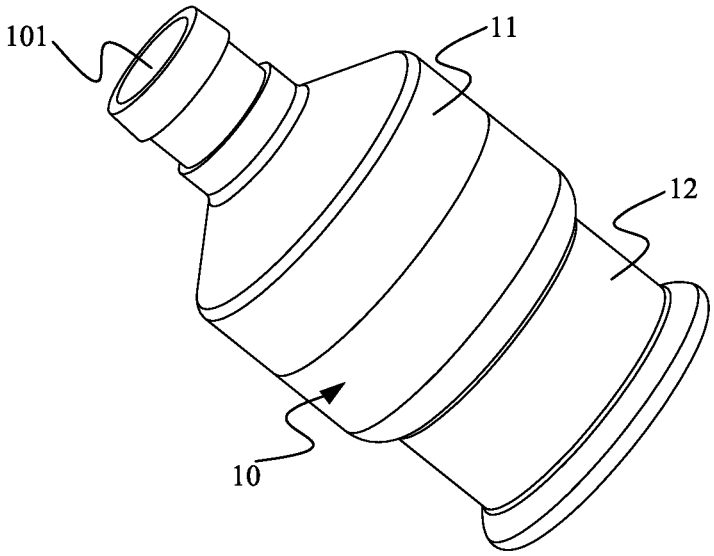
FIG. 1 is a perspective view according to a first embodiment of the present invention.
Figure 2:
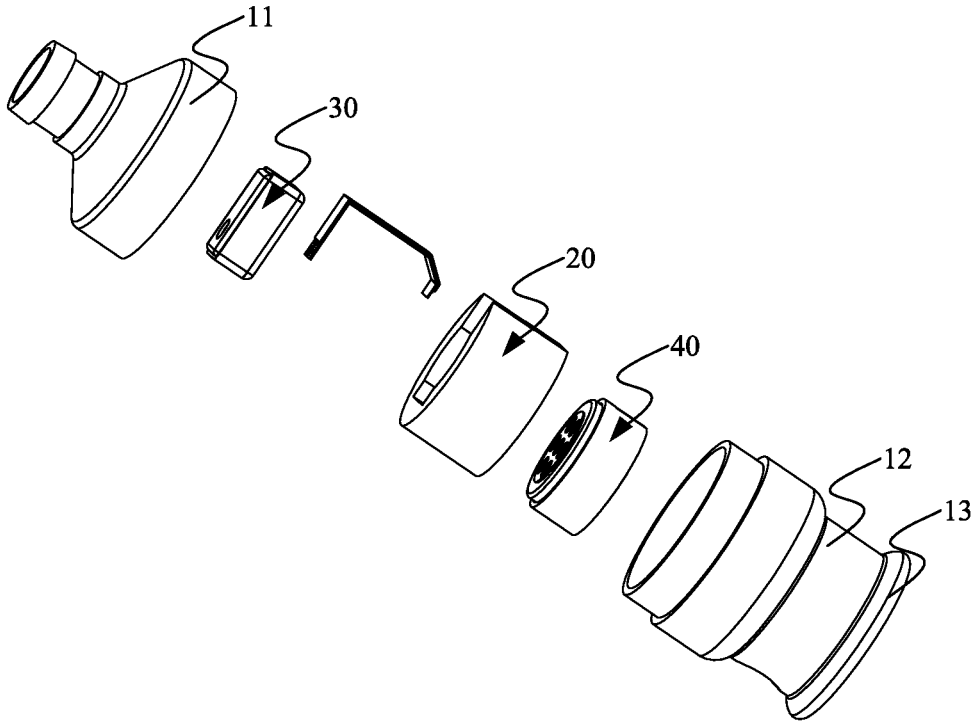
FIG. 2 is an exploded view according to the first embodiment of the present invention.
Figure 3:
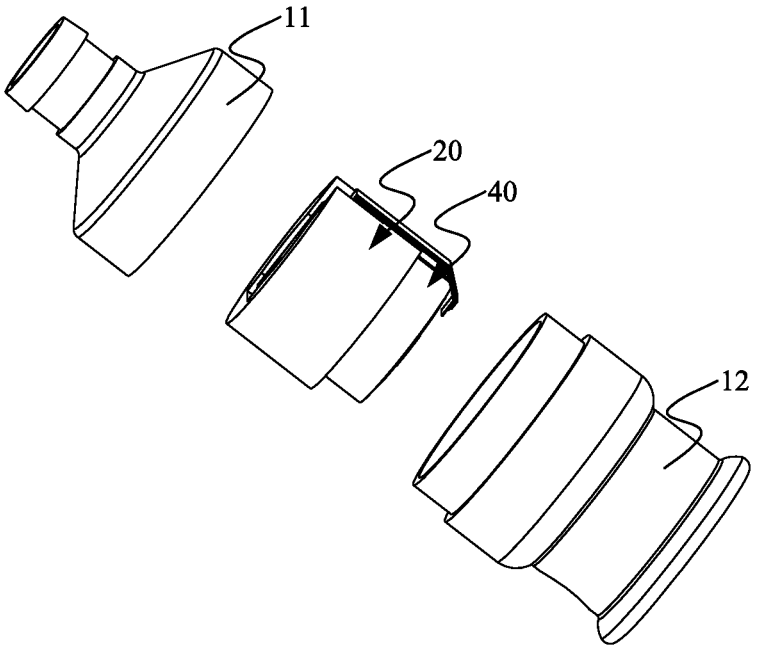
FIG. 3 is a partial assembled view according to the first embodiment of the present invention.

Referring to FIG. 1 to FIG. 3, a first embodiment of the present invention comprises a casing 10, a retaining member 20, a tweeter 30, and a woofer 40.

The casing 10 has a first sound outlet passage 101 and an accommodation space 102 therein. Specifically, the casing 10 comprises a front casing 11 and a rear casing 12. The front casing 11 comprises a base 111 and a front portion 112 extending forward from the base 111. The front portion 112 is vertically disposed on the base 111. The tail end of the rear casing 12 is formed with a flange 13. The first sound outlet passage 101 is disposed in the front casing 11. The front casing 11 and the rear casing 12 are connected with each other to define the accommodation space 102 therein. The casing 10 further has a positioning step 103 disposed in the accommodation space 102. The front casing 11 and the rear casing 12 are connected with each other.

Figure 7:
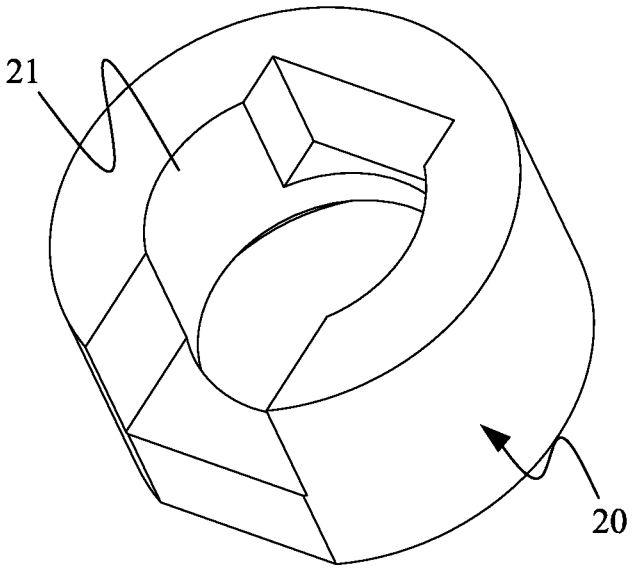
FIG. 7 is a partial enlarged view of the retaining member.
Figure 8:
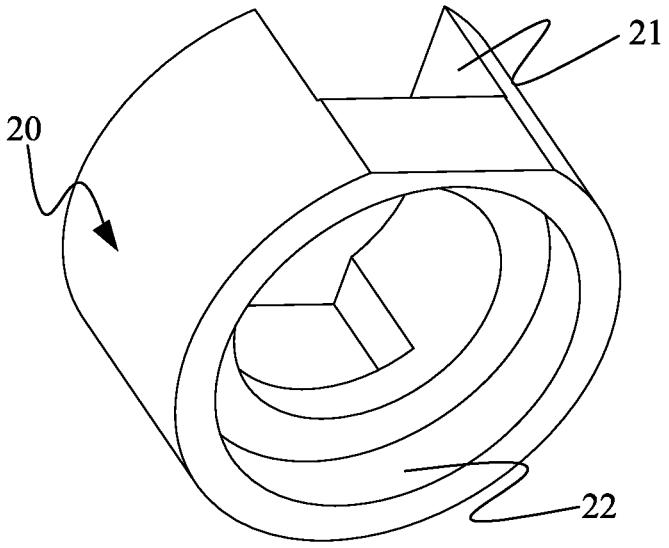
FIG. 8 is a partial enlarged view of the retaining member seen from another angle.

The retaining member 20 is installed in the accommodation space 102. Specifically, one end of the retaining member 20 is held on the positioning step 103. As shown in FIG. 7 and FIG. 8, the retaining member 20 is made of a plastic material. Two ends of the retaining member 20 are formed with a first accommodation cavity 21 and a second accommodation cavity 22, respectively.

Figure 4:
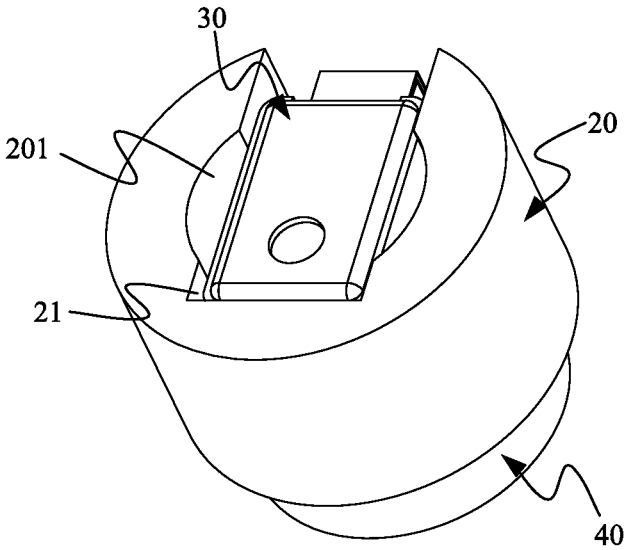
FIG. 4 is a perspective view showing that the tweeter, the woofer and the retaining member are assembled according to the first embodiment of the present invention.
Figure 5:
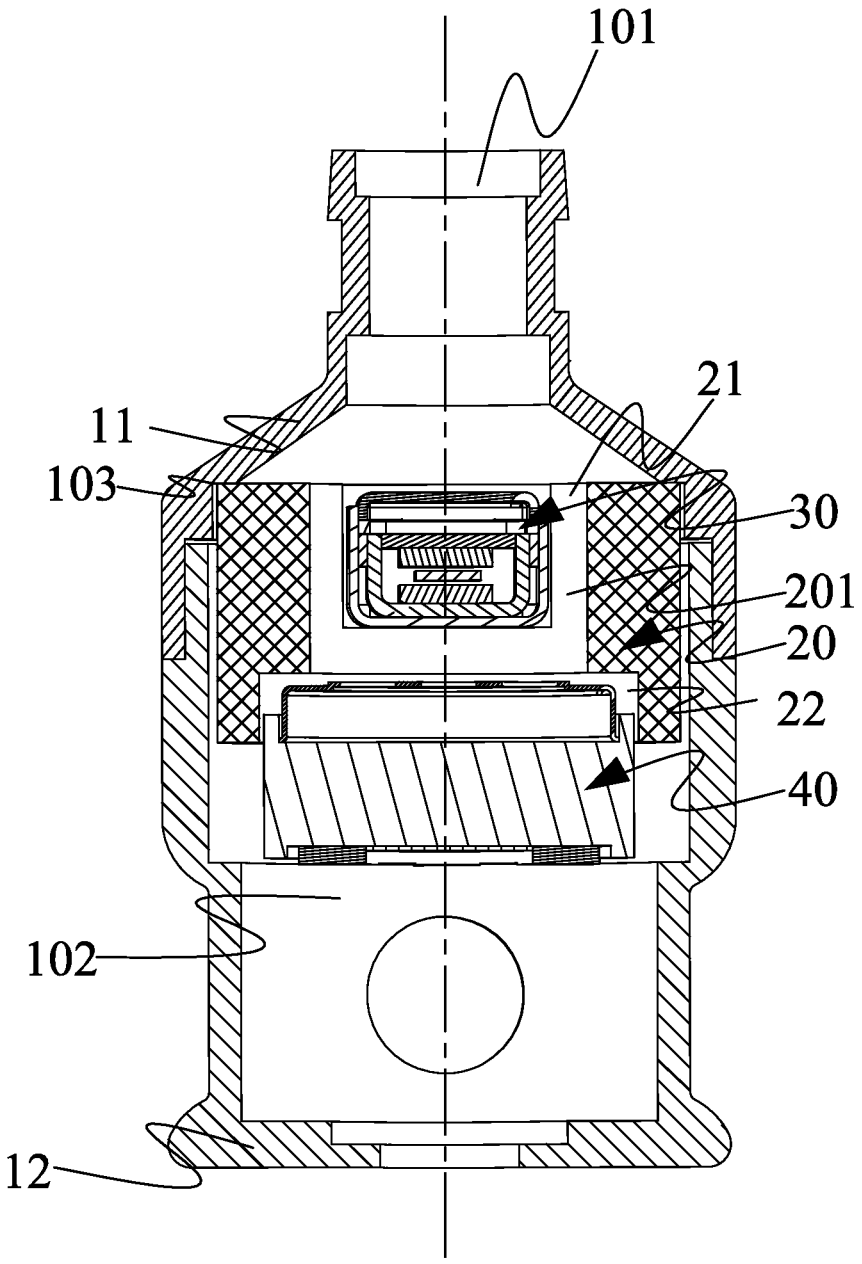
FIG. 5 is a sectional view according to the first embodiment of the present invention.
Figure 6:
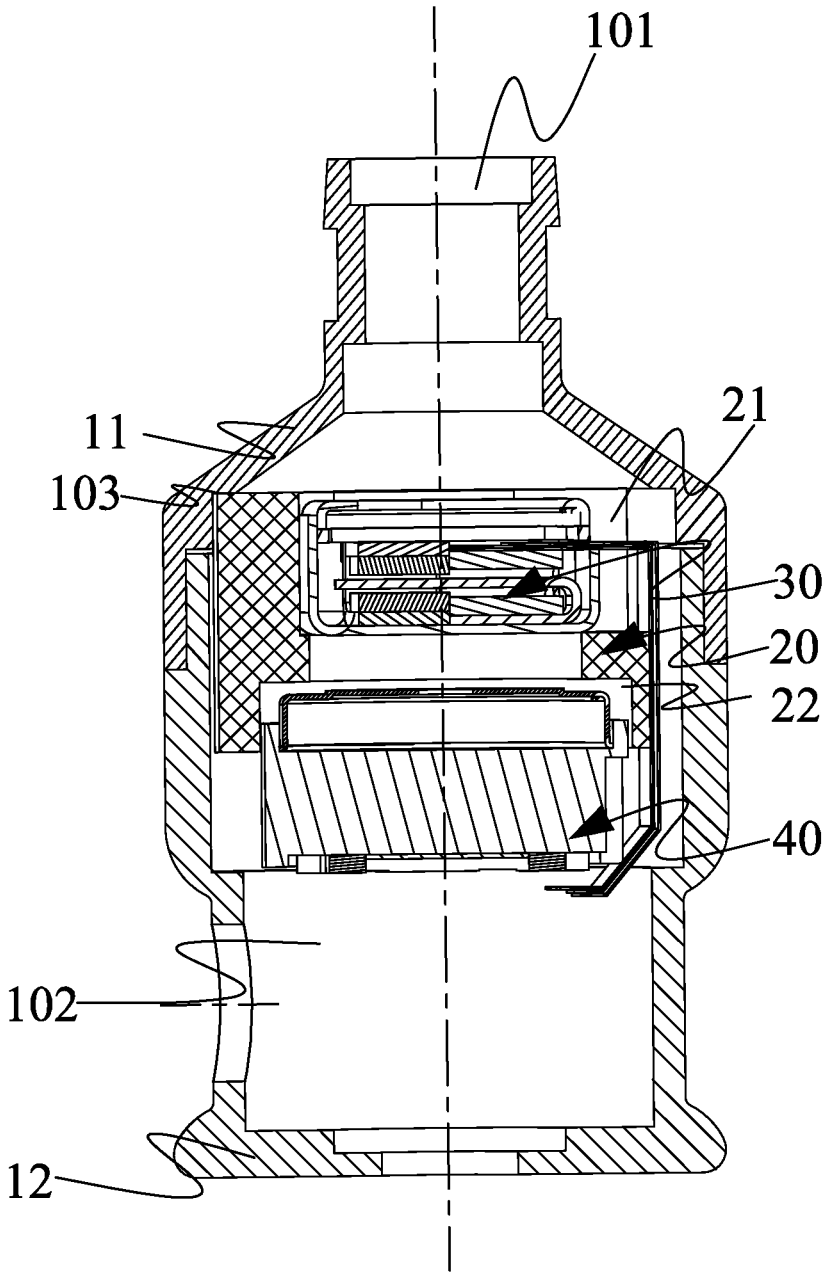
FIG. 6 is another sectional view according to the first embodiment of the present invention.

The tweeter 30 is installed in the first accommodation cavity 21. The tweeter 30 is a balanced armature loudspeaker able to sound good high pitch timbre. As shown in FIG. 4 to FIG. 6, the tweeter 30 is suspended in the first accommodation cavity 21. The tweeter 30 has a sound outlet side facing the first sound outlet passage 101. The high pitch sound from the tweeter 30 can be outputted through the first sound outlet passage 101 to the user's ear. A second sound outlet passage 201 is formed between the outer wall of the tweeter 30 and the inner wall of the first accommodation cavity 21. The second sound outlet passage 201 communicates with the first sound outlet passage 101.

The woofer 40 is installed in the second accommodation cavity 22. The woofer 40 is a moving-coil loudspeaker able to sound good low pitch timbre. The woofer 40 has a sound outlet side facing the second sound outlet passage 201. The low pitch sound from the woofer 40 passes through the second outlet passage 201 and the first sound outlet passage 101 in sequence to the user's ear.

Figure 9:
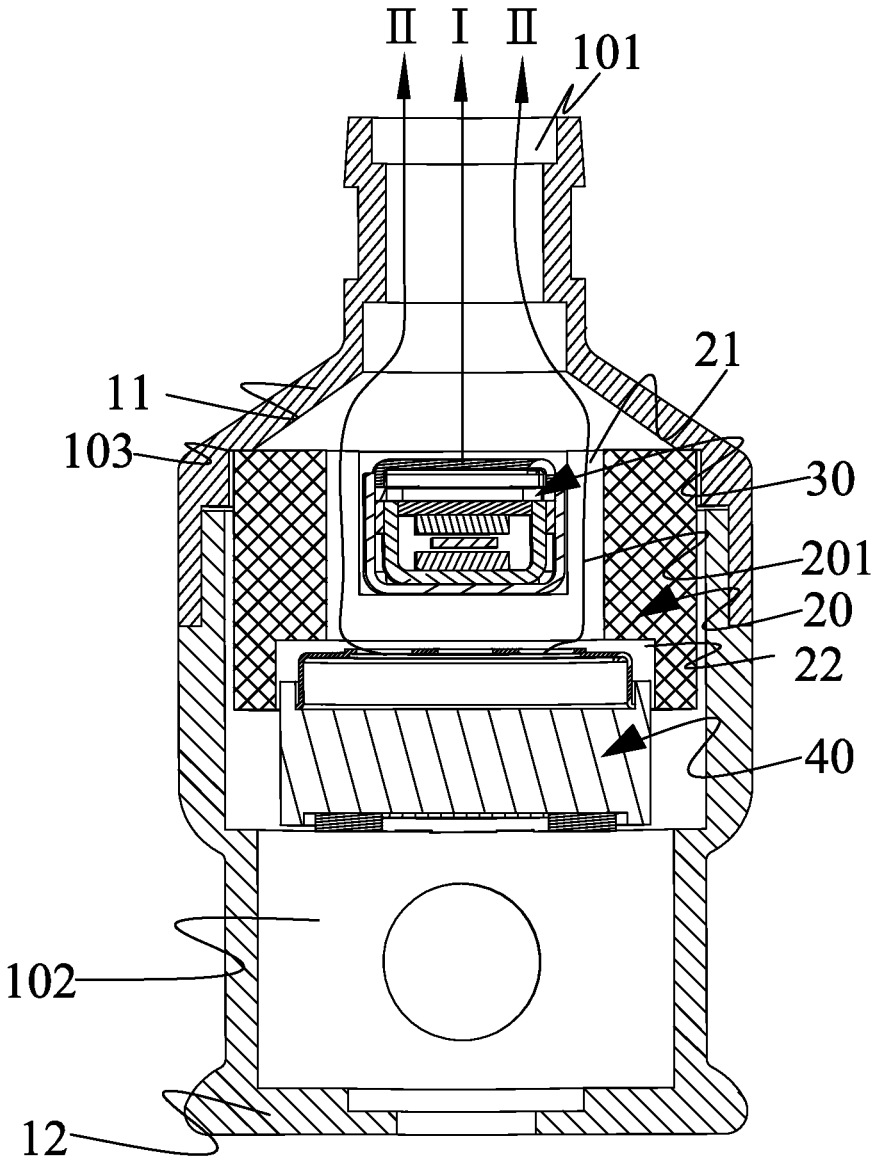
FIG. 9 is a schematic view showing the sound propagation route according to the first embodiment of the present invention, wherein I indicates the sound propagation route of the tweeter and II indicates the sound propagation route of the woofer.

The sound propagation principle of this embodiment is as follows:

As shown in FIG. 9, when in use, the high pitch sound from the tweeter 30 directly enters the user's ear through the first sound outlet passage 101 (labeled as I in FIG. 9). The low pitch sound from the woofer 40 passes through the second sound outlet passage 201, and then enters the first sound outlet passage 101, and finally enters the user's ear (labeled as II n FIG. 9). Thus, the present invention provides high pitch and low pitch effects to enhance timbre.

To assemble the present invention, the tweeter 30 is suspended in the first accommodation cavity 21, and the woofer 40 is installed in the second accommodation cavity 22. After that, the retaining member 20 is placed in the front casing 11 of the casing 10 to be held on the positioning step 103. Finally, the front casing 12 is connected to the front casing 11.

Figure 10:
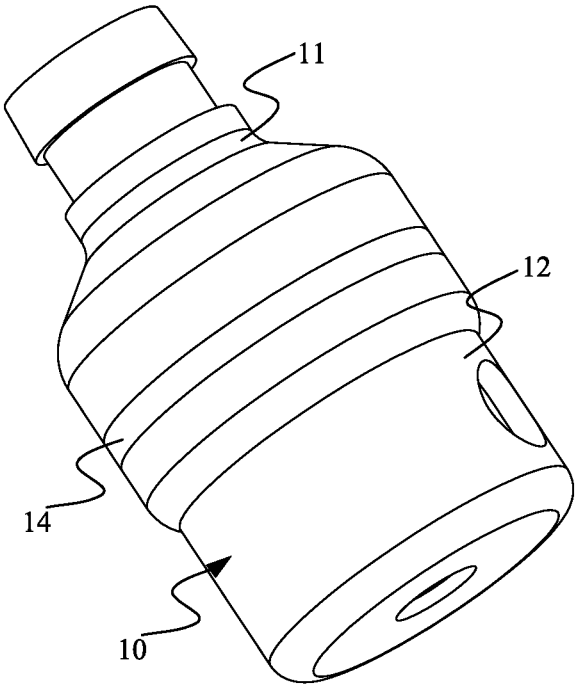
FIG. 10 is a perspective view according to a second embodiment of the present invention.
Figure 11:
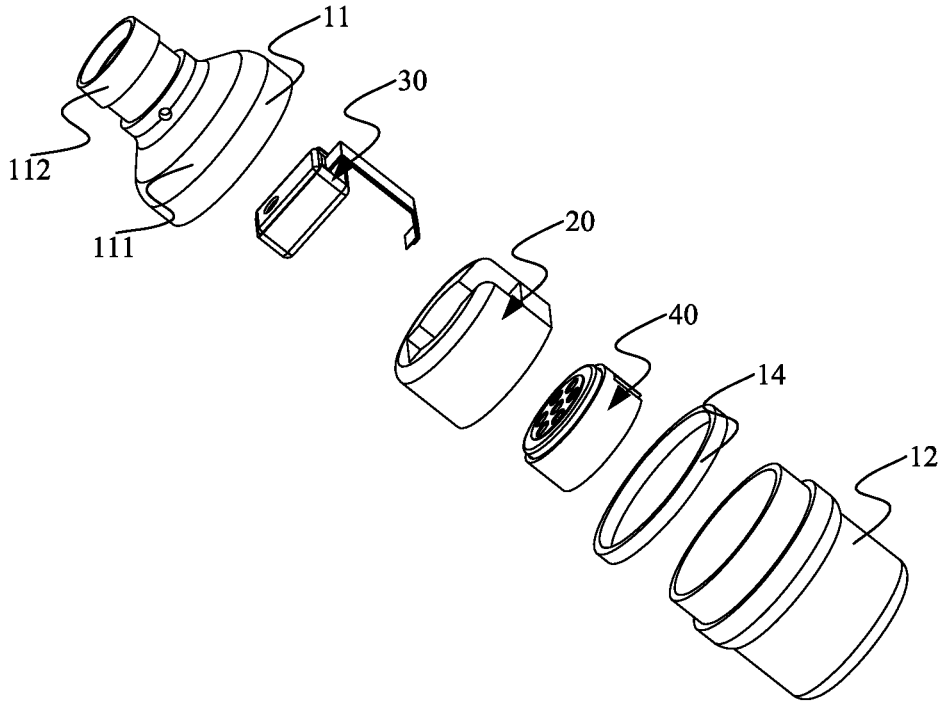
FIG. 11 is an exploded view according to the second embodiment of the present invention.
Figure 12:
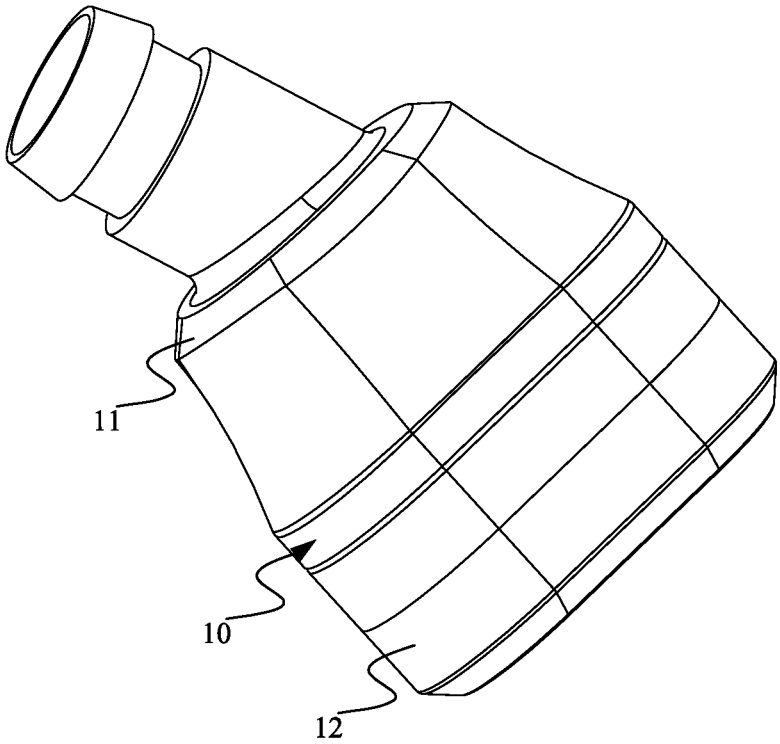
FIG. 12 is a perspective view according to a third embodiment of the present invention.
Figure 13:
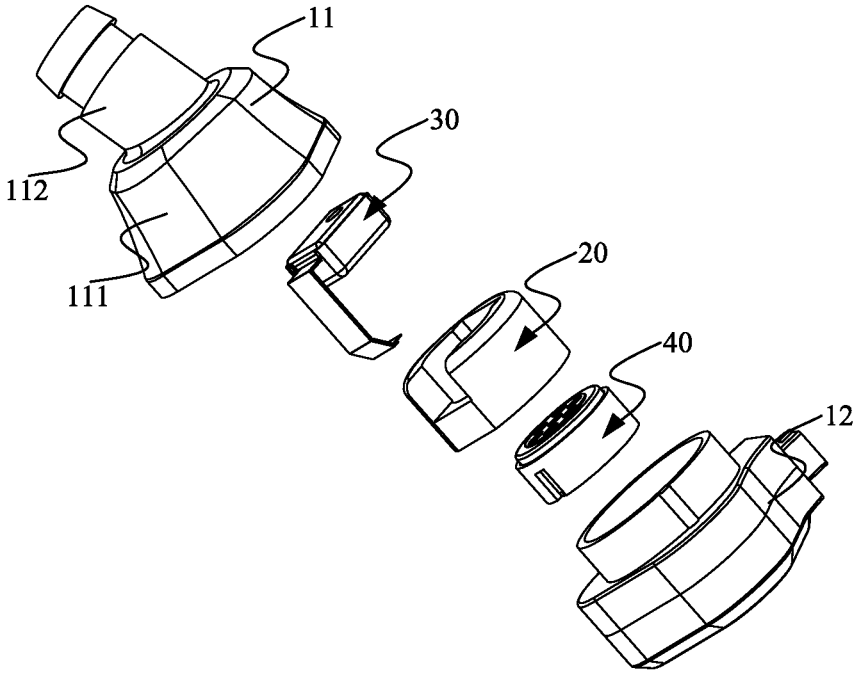
FIG. 13 is an exploded view according to the third embodiment of the present invention.
Figure 14:
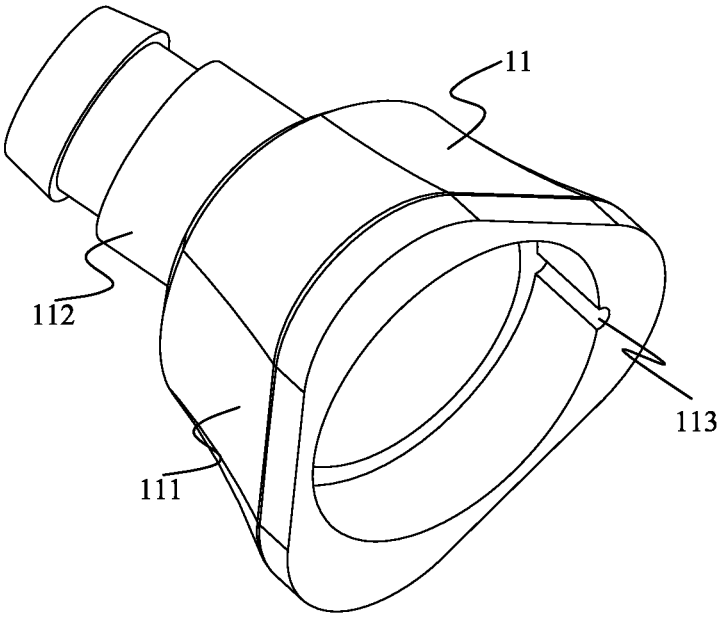
FIG. 14 is an enlarged view showing the front casing according to the third embodiment of the present invention.
Figure 15:
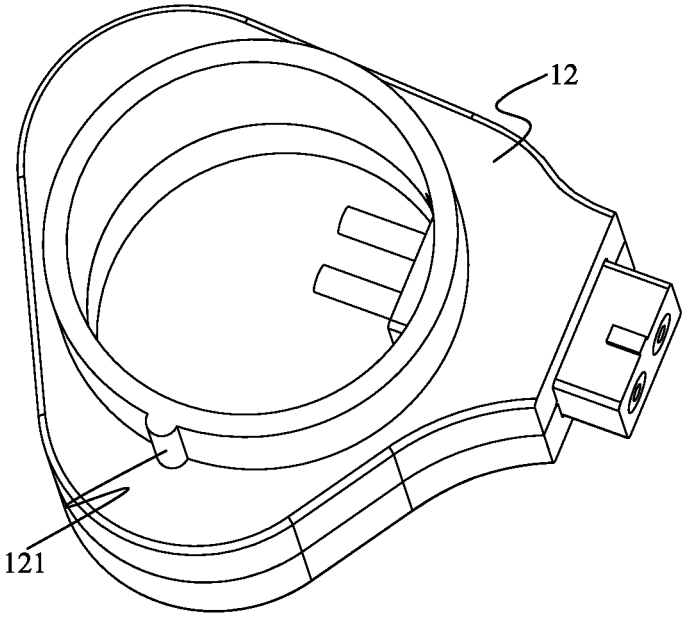
FIG. 15 is an enlarged view showing the rear casing according to the third embodiment of the present invention.

Referring to FIG. 10 to FIG. 11, a second embodiment of the present invention is substantially similar to the first embodiment with the exceptions described hereinafter. In the second embodiment, the rear casing 12 has a cylindrical configuration, and the front casing 11 and the rear casing 12 are connected through a connecting ring 14.

Referring to FIG. 12 to FIG. 15, a third embodiment of the present invention is substantially similar to the first embodiment with the exceptions described hereinafter. In the third embodiment, the cross-section of the front casing 11 is triangular. The front portion 112 is obliquely disposed on the base 111. The inner wall of the bottom of the front casing 11 is formed with a positioning groove 113. The cross-section of the rear casing 12 is also triangular. The outer wall of the rear casing 12 is provided with a positioning post 121. The positioning post 121 and the positioning groove 113 engage with each other.

The feature of the present invention is that the tweeter and the woofer are respectively installed in the first accommodation cavity and the second accommodation cavity of the retaining member and then installed in the casing. This way simplifies the assembly procedure greatly. The present invention has a simple structure and can be assembled conveniently to effectively lower the cost of the mold and the degree of difficulty to open the mold. The casing has the first sound outlet passage therein. The second sound outlet passage is formed between the outer wall of the tweeter and the inner wall of the first accommodation cavity. The second sound outlet passage communicates with the first sound outlet passage, such that high pitch sound and low pitch sound can be transmitted at the same time. The present invention can solve the problem that the cavity is not uniform so as to ensure the unity of the sound to enhance timbre.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An earphone with dual loudspeakers, comprising a casing, a retaining member, a tweeter, and a woofer, the casing having a first sound outlet passage and an accommodation space therein, the retaining member being installed in the accommodation space, two ends of the retaining member being formed with a first accommodation cavity and a second accommodation cavity, respectively, the tweeter being installed in the first accommodation cavity, the woofer being installed in the second accommodation cavity, the tweeter having a sound outlet side facing the first sound outlet passage, a second sound outlet passage being formed between an outer wall of the tweeter and an inner wall of the first accommodation cavity, the second sound outlet passage communicating with the first sound outlet passage, the woofer having a sound outlet side facing the second sound outlet passage, wherein the tweeter is suspended in the first accommodation cavity.

* * * * *